US005165872A

United States Patent [19]

Fleischmann et al.

[11] Patent Number: 5,165,872

[45] Date of Patent: Nov. 24, 1992

[54] GAS FRICTION PUMP HAVING A BELL-SHAPED ROTOR

[75] Inventors: Frank Fleischmann, Bergheim-Glessen; Hans-Peter Kabelitz, Köln; Hans Kriechel, Bornheim; Martin Mühlhoff, Köln, all of Fed. Rep. of Germany

[73] Assignee: Leybold Aktiengesellschaft, Köln, Fed. Rep. of Germany

[21] Appl. No.: 554,722

[22] Filed: Jul. 19, 1990

[30] Foreign Application Priority Data

Jul. 20, 1989 [EP] European Pat. Off. ..... 89113317.5

[51] Int. Cl.[5] ..... F04D 19/04; F04D 29/64

[52] U.S. Cl. ..... 417/423.4; 415/90; 417/423.15; 417/423.12

[58] Field of Search ..... 417/352, 353, 354, 423.12, 417/423.13, 423.15, 424.1, 424.2, 423.4; 415/90

[56] References Cited

U.S. PATENT DOCUMENTS

| | | | |
|---|---|---|---|
| 4,456,433 | 6/1984 | Henning et al. | 415/90 X |
| 4,684,317 | 8/1987 | Luijten et al. | 415/90 X |
| 4,746,265 | 5/1988 | Luijten | 415/90 |
| 4,893,985 | 1/1990 | Holss | 415/90 |

FOREIGN PATENT DOCUMENTS

| | | | |
|---|---|---|---|
| 2526164 | 12/1976 | Fed. Rep. of Germany | 417/423.4 |
| 887499 | 11/1943 | France | 415/90 |
| 154891 | 6/1988 | Japan | 415/90 |
| 159695 | 7/1988 | Japan | 415/90 |
| 1285198 | 1/1987 | U.S.S.R. | 415/90 |
| 6319 | 7/1899 | World Int. Prop. O. | 417/424.1 |

*Primary Examiner*—Leonard E. Smith

*Attorney, Agent, or Firm*—Spencer, Frank & Schneider

[57] ABSTRACT

A friction pump includes a generally cylindrical first housing part, a generally cylindrical second housing part projecting axially into the inner space of the first housing part; a bearing mounted in the second housing part coaxially therewith; and a pump rotor supported for rotation in the bearing. The pump rotor has a cylindrical shell surrounding the second housing part. The pump further has a drive motor mounted in the second housing part for driving the pump rotor; and a helical channel defined between the inner face of the first housing part and the outer face of the pump rotor for pumping gases upon rotation of the pump rotor. The second housing part, the bearing, the pump rotor and the drive motor form a single structural unit that can be axially removed from the first housing part after releasing a coupler between the two housing parts.

11 Claims, 2 Drawing Sheets

GAS FRICTION PUMP HAVING A BELL-SHAPED ROTOR

CROSS REFERENCE TO RELATED APPLICATION

This application claims the priority of European Application No. 89113317.5 filed Jul. 20, 1989, which is incorporated herein by reference.

BACKGROUND OF THE INVENTION

This invention relates to a gas friction pump having an inlet, an outlet and a bell-shaped rotor whose outer surface, together with a first housing part surrounding the rotor, forms an annular, helically extending gas pumping channel. For this purpose, either the outer surface of the rotor or the inner surface of the stator is provided with a helical construction at least in a zone close to the pump outlet. The friction pump further has a second housing part which projects into the space defined by the bell-shaped rotor and which serves for supporting the rotor and the drive motor.

Friction pumps encompass molecular and turbomolecular vacuum pumps. In molecular pumps a movable rotor wall and an immobile stator wall are so configured and so spaced from one another that the pulses imparted by the walls to the gas molecules situated between the walls have a predetermined, preferred direction. For this purpose, as a rule, the rotor and/or stator wall is provided with helically extending (thread or screw-like) depressions or ribs. Turbomolecular pumps have interengaging stator and rotor wheel series, similarly to a turbine; they need a pre-vacuum pressure of approximately $10^{-2}$ mbar. In contrast, molecular pumps deliver at pressures of 10 mbar and above so that the arrangement required for producing the pre-vacuum is much simpler.

Friction pumps of the above-outlined type, such as disclosed, for example, in German Offenlegungsschrift 3,705,912 are frequently used for evacuating vessels in which etching, coating or other vacuum treatments or manufacturing processes are performed. These processes involve the risk that solid particles may gain access to the pumps. In some processes such solid particles may come into being only during the compression of the gases, that is, during the passage of the pumped gas through the vacuum chamber. As an example there is mentioned the formation of aluminum chloride in case of aluminum etching or ammonium chloride in case of coating processes.

In case solid particles of the above-outlined type settle in the gas pumping channels of the vacuum pump, the diameter of the channels is reduced which results in a decrease of the output of the vacuum pump. Precisely in case of friction pumps which are, at least in the outlet-side zone, designed as molecular pumps, it has been found that undesired solid particles settle on the helical channel structure in the vicinity of the pump outlet.

It is a further risk that dust-like solid particles may gain access to the motor chamber which also accommodates bearings. Generally, these bearings are lubricated roller bearings which are exposed to an increased wear when dust is present.

In friction pumps which are utilized in the above-outlined pumping processes, an increased maintenance is necessary for the reasons stated. The removal of dirt from the gas pumping channels and the motor chamber necessitates a disassembly of the pump which is a complex operation, it causes a significant down time and therefore involves substantial expense.

SUMMARY OF THE INVENTION

It is an object of the invention to provide a friction pump of the above-outlined type in which the assembly operations necessary for cleaning the gas pumping channels may be performed in a simple and rapid manner. It is a further object of the invention to eliminate, to a large measure, the risk of soiling of the bearings. It is still another object of the invention to provide an improved friction pump which permits measures that prevent the formation of dust within the gas pumping channels.

This object and others to become apparent as the specification progresses, are accomplished by the invention, according to which, briefly stated, the friction pump includes a generally cylindrical first housing part, a generally cylindrical second housing part projecting axially into the inner space of the first housing part; a bearing mounted in the second housing part coaxially therewith; and a pump rotor supported for rotation in the bearing. The pump rotor has a cylindrical shell surrounding the second housing part. The pump further has a drive motor mounted in the second housing part for driving the pump rotor; and a helical channel defined between the inner face of the first housing part and the outer face of the pump rotor for pumping gases upon rotation of the pump rotor. The second housing part, the bearing, the pump rotor and the drive motor form a single structural unit that can be axially removed from the first housing part after releasing a coupler between the two housing parts.

After removal of the structural unit from the first housing part, the active pumping faces, such as the inner surface of the stator or of the first housing part or the outer surface of the rotor are freely accessible and may be cleaned in a simple manner, preferably on location. In case a defect is discovered in the unit formed of the rotor and the second housing part, a simple replacement of the unit may take place on location and after a short delay during which the assembling operation takes place, the vacuum pump is ready for operation. The defective unit may then be separately repaired by the manufacturer. Time-consuming and expensive assembly and start-up measures, such as balancing procedures need no longer be performed by the customer.

The invention provides the possibility to select a particular structure for the unit formed of the second housing part and the rotor such that the rotor and the second housing part sealingly surround the space in which the motor and the bearings are accommodated. Such a capsule-like construction prevents access of solid particles to the motor and bearing chamber and thus a premature bearing wear is avoided.

The invention further makes it possible to limit the direct contact between the first and the second housing part to small zones (narrow fitting zones with O-rings). In the zone of such contact locations temperature gradients of 30° C. and above may be maintained in case aluminum components are used. In this manner it is possible to heat the first housing part or stator to a temperature of 80° C. without a risk that the driving and bearing unit heats up to harmful temperatures. If the gas flow guiding components of the vacuum pump have temperatures of approximately 80° C., the earlier-mentioned phenomenon of dust formation during the passage of an originally exclusively gaseous medium through the pump will not occur.

DESCRIPTION OF THE PREFERRED EMBODIMENTS

Figure 1:
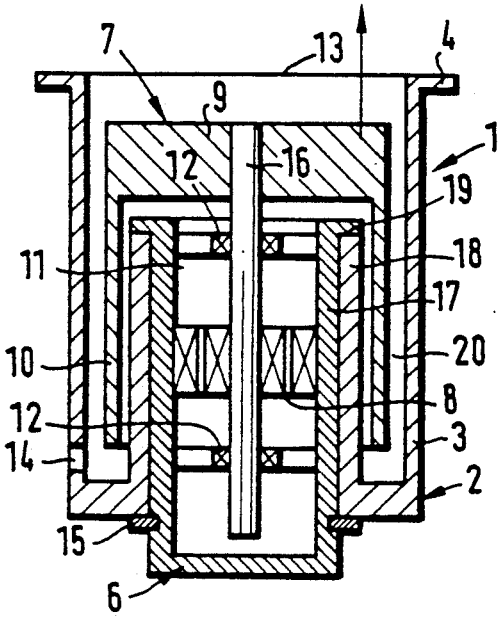
FIGS. 1–4 are schematic axial sectional views of four preferred embodiments of the invention.

All the illustrated embodiments of the friction pumps 1 have a first housing part 2 which comprises an outer cylindrical portion 3 provided with a flange 4. The friction pump 1 is, with the aid of the flange 4, directly—or with the intermediary of an adaptor flange 5 shown in FIG. 5—attached to the non-illustrated vessel to be evacuated.

The friction pumps shown in FIGS. 1–5 further have a second housing part 6 which serves for supporting the pump rotor 7 and the stator of a drive motor 8. The rotor 7 is of bell-shaped construction, it comprises a hub 9 and a cylindrical shell 10. The second housing part 6 projects into the space defined by the bell-shaped rotor 7 in which there are further accommodated the drive motor 8 and at least the upper bearing of the two rotor bearings 12. The outer surface of the rotor 7 forms, together with the inner surface of the outer cylinder 3, the active pumping surfaces, that is, the annular gas pumping channel 20. The gases are pumped from the inlet 13 towards the outlet 14 to which there is coupled, during operation, a non-illustrated pre-vacuum pump.

Both housing parts 2 and 6 are structured such that they may be separated from one another and reassembled in a simple manner. A clamping ring 15 serves for securing the two housing parts 2, 6 to one another in the assembled state.

Figure 2:
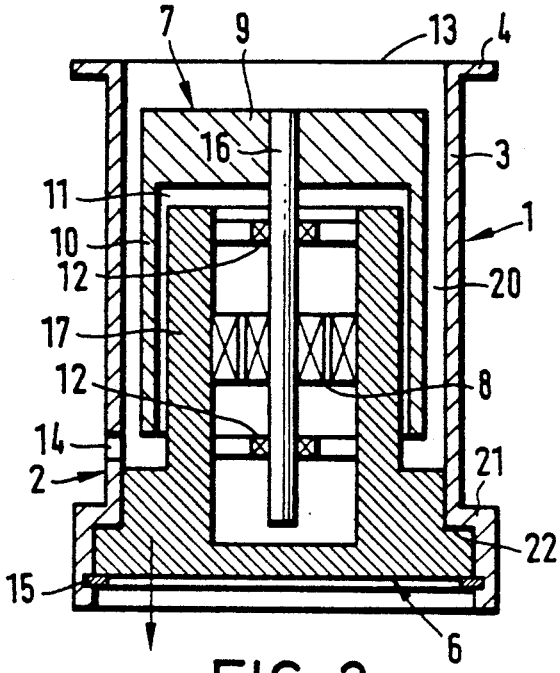
Figure 5:
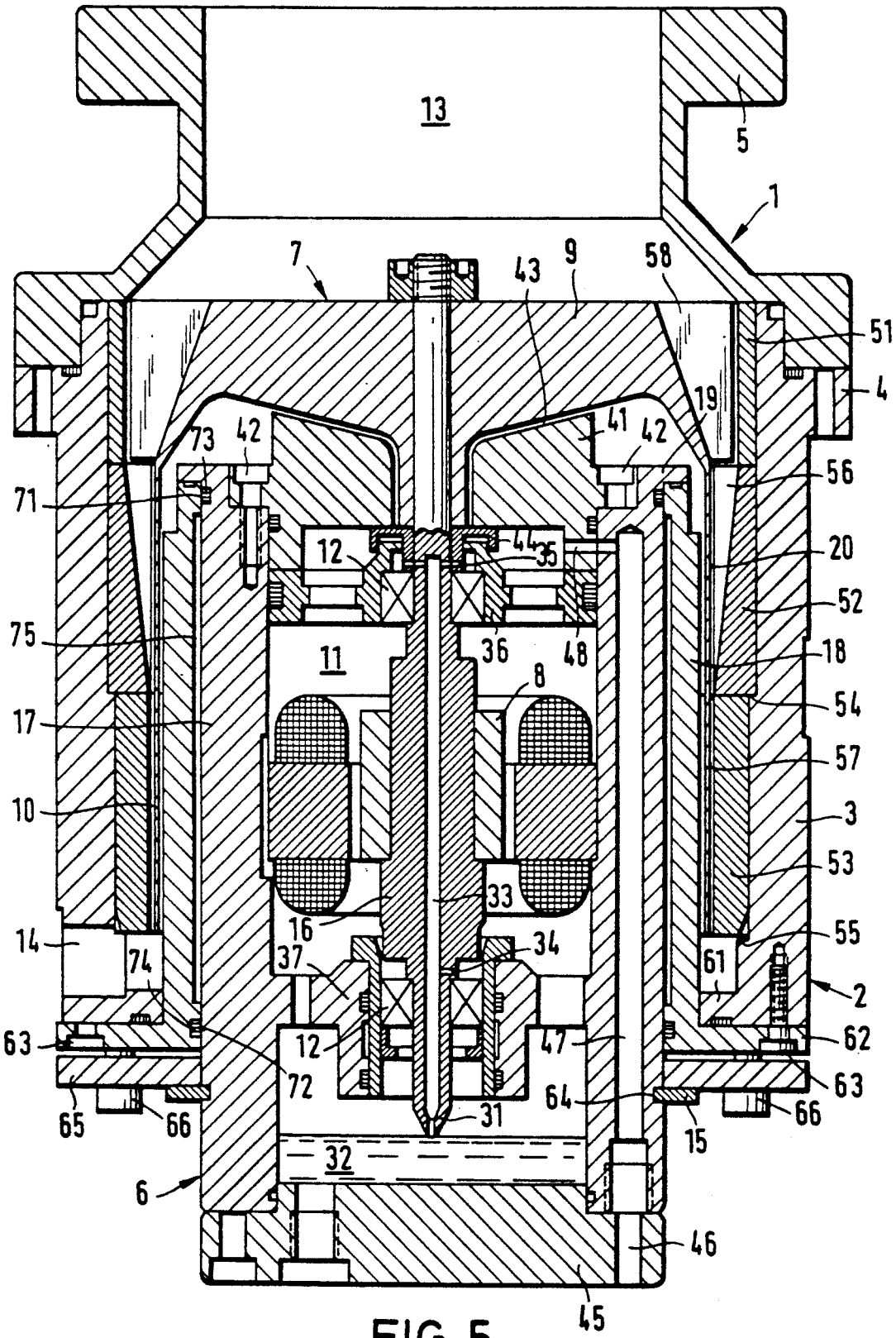
FIG. 5 is a more detailed axial sectional view of the embodiment illustrated in FIG. 1.

In the embodiments illustrated in FIGS. 1, 2 and 5 the rotor 7 is provided with a central shaft 16 which is supported by the bearings 12. The bearings 12, in turn, are supported by annular discs 36, 37 in a cylindrical portion 17 which forms a portion of the second housing part 6.

In the embodiment illustrated in FIGS. 1 and 5, the first housing part 2 has an inner cylindrical portion 18 which closely and directly surrounds the cylindrical portion 17 of the second housing part 6. The cylindrical portion 17 has a radially outwardly extending top terminal flange 19 which lies on the upper radial end face of the cylindrical portion 18. The cylindrical portion 17 projects downwardly out of the cylindrical portion 18 that is, beyond the first housing part 2, thus providing for the possibility to immobilize the two housing parts 2 and 6 with respect to one another with the aid of the clamping ring 15. After releasing the clamping ring 15, the unit formed of the rotor 7 and the second housing part 6 may be removed upwardly from the first housing part 2.

In the embodiment illustrated in FIG. 2, the first housing part 2 is formed of the cylindrical portion 3 which has an enlarged, stepped lower terminal part 21. The second housing part 6 has a corresponding stepped part 22 which fits into the stepped part 21. The outer edge of the housing part 2 axially projects beyond the housing part 6 so that again, an immobilization by a clamping ring 15 is feasible. After releasing the clamping ring 15, the unit formed of the housing part 6 and the rotor 7 may be removed downwardly from the housing part 2.

Figure 3:
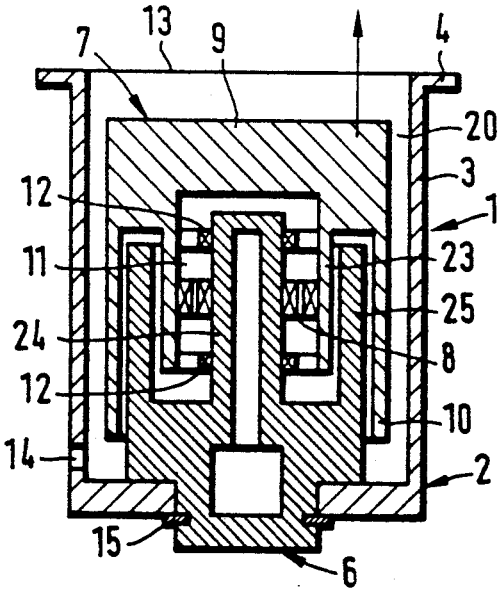
Figure 4:
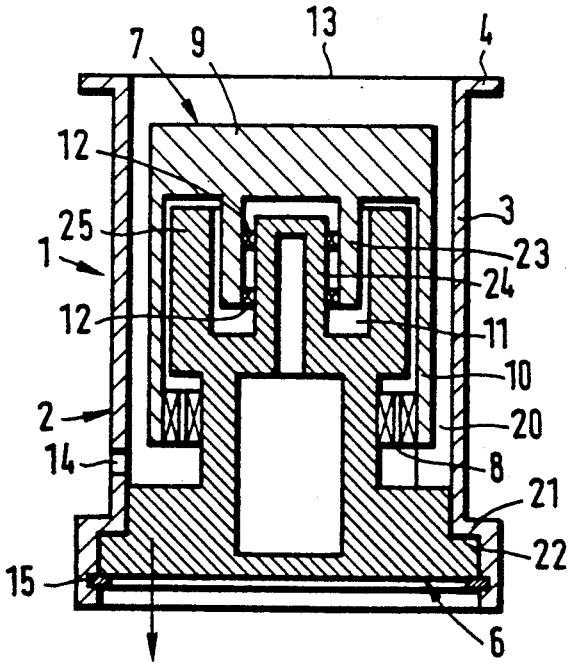

In the embodiments illustrated in FIGS. 3 and 4 the rotor 7 is, by means of its cylindrical (tubular) portion 23, supported on a central stationary stub 24 by means of the bearings 12. The stub 24 is a component of the second housing part 6. A cylindrical portion 25 which too, is a component of the second housing part 6, projects into the annular space formed by the inner cylindrical portion 23 and the outer cylindrical portion 10 of the bell-shaped rotor 7. This arrangement forms a labyrinth seal which is particularly effective in preventing dust particles from entering into the bearing chamber.

In the embodiment illustrated in FIGS. 3 and 4, the drive motor 8 is of the outer rotor type. It may be positioned between the stub 24 and the cylindrical portion 23 (FIG. 3) or in the zone of the lower edge of the bell-shaped rotor 7 (FIG. 4). For immobilizing the two housing parts 2 and 6, means are used which encompass the clamping ring 15 and corresponding stepped portions 21, 22 (FIG. 4) as described in conjunction with FIGS. 1 and 2.

With particular reference to FIG. 5 which shows the FIG. 1 embodiment in further detail, it is seen that inside the outwardly sealed space 11 formed by the rotor 7 and the housing part 6, a lubricating arrangement is provided for the bearings 12 which support the shaft 16. The shaft 16 has a conical lower terminus 31 which projects into an oil sump 32. The shaft further has an axial oil channel 33 and radial ports 34 and 35 through which the oil rising in the central, axial channel 3 is ejected by centrifugal forces onto the bearings 12. As noted earlier, the bearings 12 are supported by annular discs 36 and 37 in the cylindrical portion 17 of the housing part 2.

A fitting 41 which serves to seal the space 11 against the rotor 7, is, by means of screws 42, tightened to the upper zone of the cylindrical portion 17 of the housing part 6. The fitting 41 conforms to the shape of the underside of the hub portion 9 of the rotor 7 in such a manner that a gap seal 43 is obtained which terminates, open-ended, above the bearing 12. To prevent a direct access of oil vapors into the gap 43, the upper bearing 12 is provided with an annular covering cap 44 which is secured to the shaft 16 and extends over the upper bearing 12.

The structural components of the housing part 6 (that is, the cylindrical portion 17, the fitting 41 and the bottom 45 of the oil sump 32) are provided with ports 46, 47 and 48 through which a scavenging gas (such as an inert gas like nitrogen or argon) may be introduced into the chamber 11. The scavenging gas passes through the gap seal 43 and through the gap formed by the inner face of the cylindrical portion 10 of the rotor 7 and the outer face of the cylindrical portion 18 of the housing part 2 and thus reaches the pump outlet 14. The scavenging gas stream prevents dust-laden gas from gaining access to the motor and bearing chamber 11. It is a particular advantage of this arrangement that the scavenging gas stream may be maintained even during a disassembly of the pump so that in this phase the motor and bearing chamber 11 continue to be protected from dust particles.

The cylindrical shell portion 10 of the rotor 7 has a relatively thin wall, whereby the rotary mass of the rotor 7 is maintained small. The helical constructions providing for a pumping of the gas are part of the stator.

In the cylindrical housing portion 3 there are provided separate rings 51; 52 and 53 which are supported by shoulders or steps 54 and 55 in the housing portion 3. The rings 52 and 53 are, on their inner faces, provided with helical structures 56 and 57 which, together with the outer faces of the cylindrical portion 10 of the rotor 7 effect a pumping of the gas in the direction of the outlet 14. With the aid of the adaptor flange 5, the rings 51, 52 and 53 are immobilized in their position in the mounted state. After releasing the adaptor flange 5, first the unit formed of the rotor 7 and the housing part 6 and thereafter the rings 51, 52 and 53 may be removed upwardly from the housing portion 3.

The ring 51 has a smooth inner surface; the helical structures 58 which effect the pumping of the gases are provided on the periphery of the rotor hub 9. This construction may be similar to that disclosed in European Patent Application 88116749.8, that is, there are provided radially extending webs whose width and pitch decrease from the suction side towards the pressure side. In this manner there is obtained an effective charging stage 51, 58 with an improved pumping output. As noted before, the first housing part 2 is formed of the outer cylindrical portion 3 and the inner cylindrical portion 18. In the zone of the outlet side 14, the cylindrical portions 3 and 18 have respective flange-like ends 61, 62 which are tightened to one another by screws 63. The housing part 6 projects downwardly from the housing part 2 and is provided with a circumferential groove 64 for receiving the clamping ring 15. Additionally, there is provided a ring 65 which surrounds the housing part 6 and which in turn, is supported by the clamping ring 15. After an assembly of the structural parts, the ring 65 is pushed on the construction and the clamping ring 15 is seated in the groove 64. A securing of the position of the components with respect to one another is effected by means of screws 66 which are threaded through the ring 65. After the complete assembly, by turning the screws 66 there is achieved a securement of the mutual desired position of the two housing parts 2 and 6.

The cylindrical portion 17 of the housing part 6 is guided in the cylindrical portion 18 of the housing part 2. For this purpose, there are provided two relatively narrow fitting guides 71 and 72. In these zones, sealing rings 73 and 74 are disposed which are received in corresponding grooves. The two cylindrical portions 17 and 18 are spaced from one another by a clearance 75. This arrangement makes it possible to maintain a temperature gradient between the two components 17 and 18 and thus a heating of the stator portions up to 80° C. for preventing dust formation does not lead to an excessive thermal stress on the bearing and motor components accommodated in the housing part 6.

It will be understood that the above description of the present invention is susceptible to various modifications, changes and adaptations, and the same are intended to be comprehended within the meaning and range of equivalents of the appended claims.

What is claimed is:

1. In a friction pump including a pump inlet and a pump outlet;

a generally cylindrical first housing part having an inner face and defining an inner space;

a generally cylindrical second housing part projecting axially into the inner space;

securing means for securing said first and second housing parts to one another;

a bearing mounted in said second housing part coaxially therewith;

a pump rotor supported for rotation in said bearing; said pump rotor having a cylindrical shell having an outer face and surrounding a cylindrical portion of said second housing part;

a drive motor mounted in said second housing part and drivingly coupled to said pump rotor; and helical channel means defined between the inner face of the first housing part and the outer face of the pump rotor for pumping gases upon rotation of the pump rotor;

the improvement wherein said second housing part, said bearing, said pump rotor and said drive motor form a single structural unit having axial removability from said first housing part after releasing said securing means; further wherein said pump rotor has a tubular portion extending into said second housing part and said second housing part has a stub portion extending into said tubular portion; said bearing being supported on said stub portion and rotarily supporting said pump rotor by engaging said tubular portion; said cylindrical portion of said second housing part surrounding said tubular portion of said pump rotor; said cylindrical shell of said pump rotor, said cylindrical portion of said second housing part and said tubular portion of said pump rotor together defining a labyrinth seal.

2. In a friction pump including a pump inlet and a pump outlet;

a generally cylindrical first housing part having an inner face and defining an inner space;

a generally cylindrical second housing part projecting axially into the inner space;

securing means for securing said first and second housing parts to one another;

a bearing mounted in said second housing part coaxially therewith;

a pump rotor supported for rotation in said bearing; said pump rotor having a hub and a cylindrical shell having an outer face and surrounding a cylindrical portion of said second housing part;

a drive motor mounted in said second housing part and drivingly coupled to said pump rotor; and helical channel means defined between the inner face of the first housing part and the outer face of the pump rotor for pumping gases upon rotation of the pump rotor;

the improvement wherein said second housing part, said bearing, said pump rotor and said drive motor form a single structural unit having axial removability from said first housing part after releasing said securing means; the improvement further comprising (a) a scavenging gas inlet means for introducing a scavenging gas into a space surrounded by said second housing part; said drive motor and said bearing being accommodated in said space;

(b) an annular fitting secured to said second housing part and covering an end thereof; said hub being situated externally of said second housing part and adjoining the fitting; said fitting and said hub together defining a gap seal for sealing off said space against a pump environment surrounding said second housing part; and (c) two fitting guides defined between the first and second housing parts; said fitting guides having a small axial length relative to axial lengths of said first and second housing parts; said fitting guides constituting sole axial contact regions between said first and second housing parts for effecting a thermal separation therebetween.

3. A friction pump as defined in claim 2, wherein said securing means comprises a clamping ring immobilizing said first and second housing parts relative to one another.

4. A friction pump as defined in claim 2, further comprising an annular disc held on an inner cylindrical wall of said second housing part; said bearing being held by said annular disc; said pump rotor having a shaft extending within said second housing part coaxially therewith and being rotatably supported in said bearing.

5. A friction pump as defined in claim 2, further comprising a charging stage situated adjacent said pump inlet; said charging stage comprising webs attached to said pump rotor and extending radially outwardly therefrom; said webs having a width and a pitch decreasing in a direction viewed axially from said pump inlet towards said pump outlet.

6. A friction pump as defined in claim 2, wherein said bearing is situated within said second housing part and adjoins said fitting; further comprising a cap situated between said bearing and said fitting and covering said bearing; said gap seal terminating at said cap.

7. A friction pump as defined in claim 2, wherein said pump rotor has a tubular portion extending into said second housing part and said second housing part has a stub portion extending into said tubular portion; further wherein said bearing is supported on said stub portion and rotarily supports said pump rotor by engaging said tubular portion.

8. A friction pump as defined in claim 2, further comprising O-rings sealingly disposed between said first and second housing parts at said fitting guides.

9. A friction pump as defined in claim 2, wherein said helical channel means are provided at least in a zone adjacent said pump outlet and being supported stationarily on said first housing part.

10. A friction pump as defined in claim 2, wherein said cylindrical shell of said pump rotor and said second housing part closely surround a space accommodating said bearing assembly and said drive motor.

11. A friction pump as defined in claim 10, wherein said cylindrical shell of said pump rotor has an inner cylinder face and said second housing part has an outer cylinder face; said cylinder faces together defining a gap seal.

* * * * *